US010584549B2

(12) United States Patent
Helvenston et al.

(10) Patent No.: US 10,584,549 B2
(45) Date of Patent: Mar. 10, 2020

(54) COILED TUBING SPLIT-TYPE RUNNING AND RETRIEVABLE CLAMP TOOL

(71) Applicant: GE Oil & Gas Pressure Control LP, Houston, TX (US)

(72) Inventors: Andrew Browne Helvenston, Houston, TX (US); Eugene Allen Borak, Houston, TX (US); Vanson Huynh, Houston, TX (US)

(73) Assignee: GE Oil & Gas Pressure Control LP, Houston, TX (US)

( * ) Notice: Subject to any disclaimer, the term of this patent is extended or adjusted under 35 U.S.C. 154(b) by 73 days.

(21) Appl. No.: 15/180,507

(22) Filed: Jun. 13, 2016

(65) Prior Publication Data

US 2017/0130535 A1 May 11, 2017

Related U.S. Application Data

(60) Provisional application No. 62/251,899, filed on Nov. 6, 2015.

(51) Int. Cl.

| | |
|---|---|
| ***E21B 17/00*** | (2006.01) |
| ***E21B 17/20*** | (2006.01) |
| ***E21B 23/00*** | (2006.01) |
| ***E21B 33/072*** | (2006.01) |

(52) U.S. Cl.

CPC ..... *E21B 23/00* (2013.01); *E21B 33/072* (2013.01)

(58) Field of Classification Search

CPC ..... E21B 17/10; E21B 33/0415; E21B 17/20
USPC ..... 294/86.1
See application file for complete search history.

(56) References Cited

U.S. PATENT DOCUMENTS

| | | | | |
|---|---|---|---|---|
| 4,361,353 | A | 11/1982 | Vinson | |
| 4,625,381 | A | 12/1986 | Gravouia, Jr. | |
| 4,995,458 | A | 2/1991 | Garbett | |
| 5,044,438 | A * | 9/1991 | Young | E21B 17/1007 166/382 |
| 5,152,343 | A * | 10/1992 | Kilgore | E21B 17/02 137/155 |
| 6,264,244 | B1 * | 7/2001 | Isennock | E21B 17/02 138/109 |
| 2005/0189116 | A1 * | 9/2005 | See | E21B 33/076 166/344 |
| 2010/0270746 | A1 * | 10/2010 | Van Winkle | E21B 33/076 277/322 |

* cited by examiner

*Primary Examiner* — David J Bagnell
*Assistant Examiner* — Dany E Akakpo
(74) *Attorney, Agent, or Firm* — Hogan Lovells US LLP

(57) ABSTRACT

A method for completing a well includes extending coiled tubing into the well through a wellhead assembly, the coiled tubing having a lower end within the well and an upper end outside of the well. A tool is releasably attached to a central portion of the coiled tubing between the lower and upper ends. The tool has a tool body has an inner diameter surface sized to circumscribe the coiled tubing. A gripping feature is located on the inner diameter surface for limiting relative axial movement between the tool and the coiled tubing when the inner diameter of the tool circumscribes the coiled tubing. A tool feature extends from the tool body and is shaped to engage a well member. The tool is lowered into the well with the coiled tubing and the tool feature engages the well member. The tool is removed from the well with the coiled tubing.

26 Claims, 3 Drawing Sheets

COILED TUBING SPLIT-TYPE RUNNING AND RETRIEVABLE CLAMP TOOL

CROSS REFERENCE TO RELATED APPLICATION

This application claims priority to and the benefit of U.S. Provisional Application Ser. No. 62/251,899, filed Nov. 6, 2015, titled "Coiled Tubing Split-Type Running and Retrieval Clamp Tool," the full disclosure of which is hereby incorporated herein by reference in its entirety for all purposes.

BACKGROUND

1. Field of the Disclosure

The present disclosure relates in general to completing hydrocarbon production wells and more particularly, to systems and methods for performing functions within wells with a tool during coiled tubing operations.

2. Description of Related Art

Coiled tubing is being used with increasing frequency during hydrocarbon drilling and production operations. As an example, coiled tubing can be used to suspend and install electric submersible pumps or other downhole members within a subterranean well. During the running of the coiled tubing into the well, it may be desirable to perform certain operations that require a tool to be lowered into, and retrieved out of, the well. As an example, a brush or other cleaning tool may be lowered into and retrieved out of the well to perform cleaning operations. In other examples, bowl protectors are sometimes used to prevent damage to wellhead inner diameter surfaces, such as bore seal surfaces, as equipment passes through the wellhead. A bowl protector is a generally elongated sleeve-like element that traditionally is removed after drilling operations and prior to running casing or tubing into the well. However, removal of the bowl protector leaves the bore seal surfaces unprotected and thus highly vulnerable to damage by centralizers, coiled tubing, casing collars and other equipment that must pass through the wellhead after drilling operations. It is imperative that bore seal surfaces remain free of scars in order to be able to set the metal to metal, elastomeric, or other types of seals that are used to pack off the annular space within the wellhead. However, some current tools must be run at one of the ends of the coiled tubing, or before or after the coiled tubing operations are performed.

During coiled tubing operations, the coiled tubing cannot be rotated and therefore tools that require rotation, such as traditional tools used with common casing or tubulars, cannot be used with coiled tubing. In addition, coiled tubing is fed into the well as a continuous single member with no breaks or connections that could be used for attaching a tool.

SUMMARY OF THE DISCLOSURE

Embodiments of this disclosure provide systems and methods for enabling a tool to be run into and retrieved out of a well along a center portion of coiled tubing. The tool can be clamped onto and ride along coiled tubing as coiled tubing is lowered into the well. The tool can perform a function and then the coiled tubing can be pulled up again. As an example, the tool can be a brush or other cleaning tool. In other examples, the tool can be a split tool that clamps around the coiled tubing that is lowered into the well after the electric submersible pump or other downhole member is run into the well and can be used to retrieve the bowl protector. In this way, the inner wellhead member, such as the spool, can be protected by a bowl protector without having to interrupt normal coiled tubing running operations. This also allows for protection of the spool while the coiled tubing is being run, and for the protection to be removed so that it does not take up space during further operation of the well, such as the landing of hangers and while the well is producing.

In an embodiment of the current disclosure, a method for completing a well includes extending coiled tubing into the well through a wellhead assembly of the well, the coiled tubing having a lower end within the well and an upper end outside of the well. A tool is releasably attached to a central portion of the coiled tubing between the lower end and the upper end. The tool has a tool body having a central axis and an inner diameter surface sized to circumscribe the coiled tubing. A gripping feature is located on the inner diameter surface, the gripping feature limiting relative axial movement between the tool and the coiled tubing when the inner diameter of the tool circumscribes the coiled tubing. A tool feature extends from the tool body and is shaped to engage a well member. The tool is lowered into the well with the coiled tubing and the tool feature engages the well member. The tool is removed from the well with the coiled tubing.

In an alternate embodiment of this disclosure, a method for completing a well includes securing a downhole member to a lower end of coiled tubing. The coiled tubing is extended into the well through a wellhead assembly of the well, so that the lower end is located within the well and an upper end of the coiled tubing is outside of the well. A retrieval tool is releasably attached to a central portion of the coiled tubing between the lower end and the upper end. The retrieval tool has a tool body having a central axis and an inner diameter surface sized to circumscribe the coiled tubing. A gripping feature is located on the inner diameter surface, the gripping feature limiting relative axial movement between the retrieval tool and the coiled tubing when the inner diameter of the retrieval tool circumscribes the coiled tubing. A latching assembly extends from the tool body and is shaped to engage the split bowl protector. The retrieval tool is lowered into the well with the coiled tubing and engaging the split bowl protector with the latching assembly. The retrieval tool and the split bowl protector are retrieved from the well with the coiled tubing.

In yet another embodiment of this disclosure, a system for completing a well includes a tool that is releasably attachable to coiled tubing. The tool includes a tool body having a central axis and an inner diameter surface sized and adapted to circumscribe a central portion of the coiled tubing between the lower end and the upper end. A gripping feature is located on the inner diameter surface, the gripping feature operable to limit relative axial movement between the tool and the coiled tubing when the inner diameter of the tool circumscribes the coiled tubing. A tool feature extends from the tool body and is shaped to engage a well member.

BRIEF DESCRIPTION OF DRAWINGS

Some of the features and benefits of the present disclosure having been stated, others will become apparent as the description proceeds when taken in conjunction with the accompanying drawings, in which.

Figure 1:
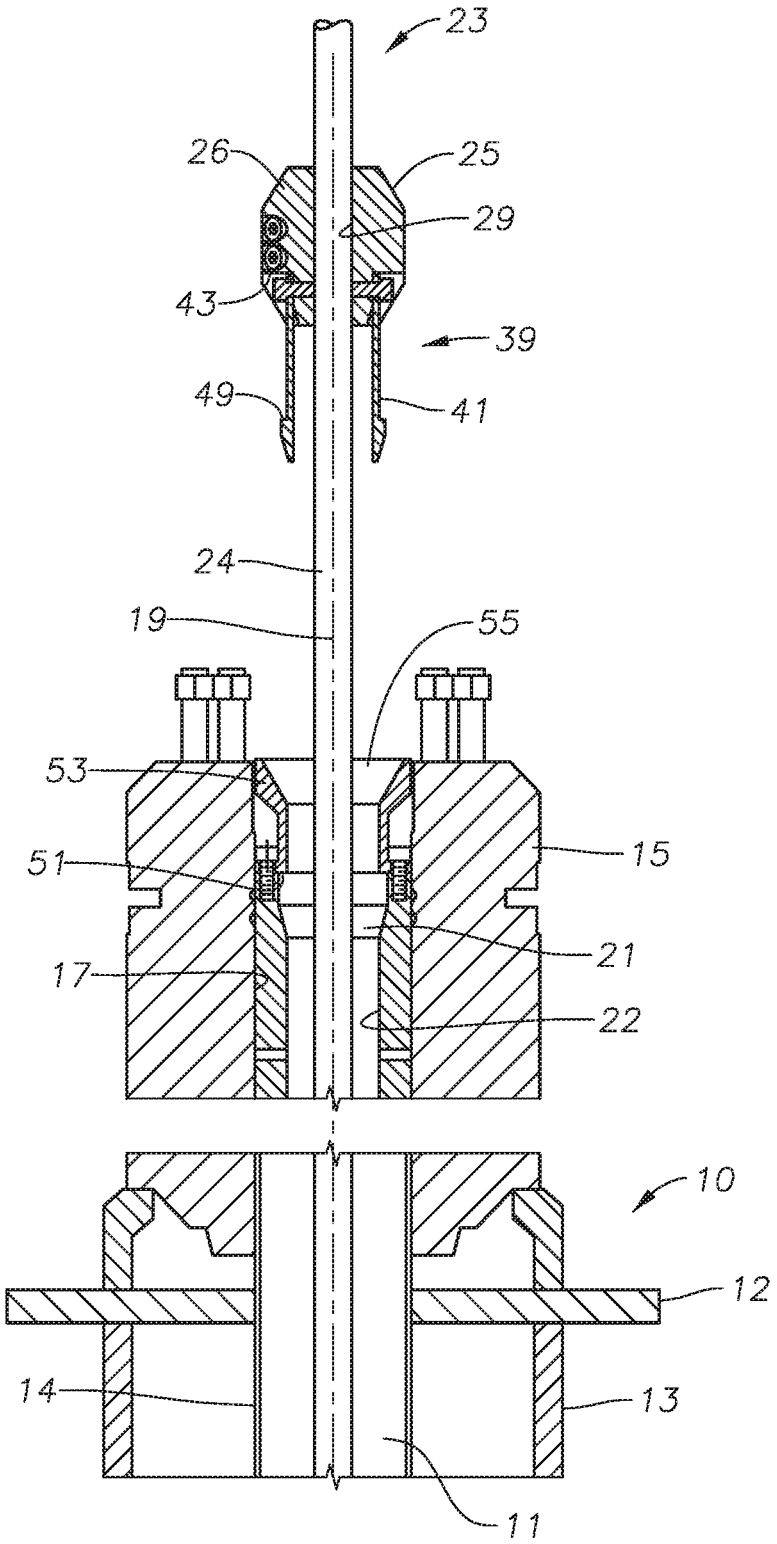
FIG. 1 is a sectional view of a tool being lowered on coiled tubing into a wellhead with a bowl protector, in accordance with an embodiment of this disclosure.

While the disclosure will be described in connection with the example embodiments, it will be understood that it is not intended to limit the disclosure to that embodiment. On the contrary, it is intended to cover all alternatives, modifications, and equivalents, as may be included within the spirit and scope of the disclosure as defined by the appended claims.

DETAILED DESCRIPTION OF DISCLOSURE

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 4:
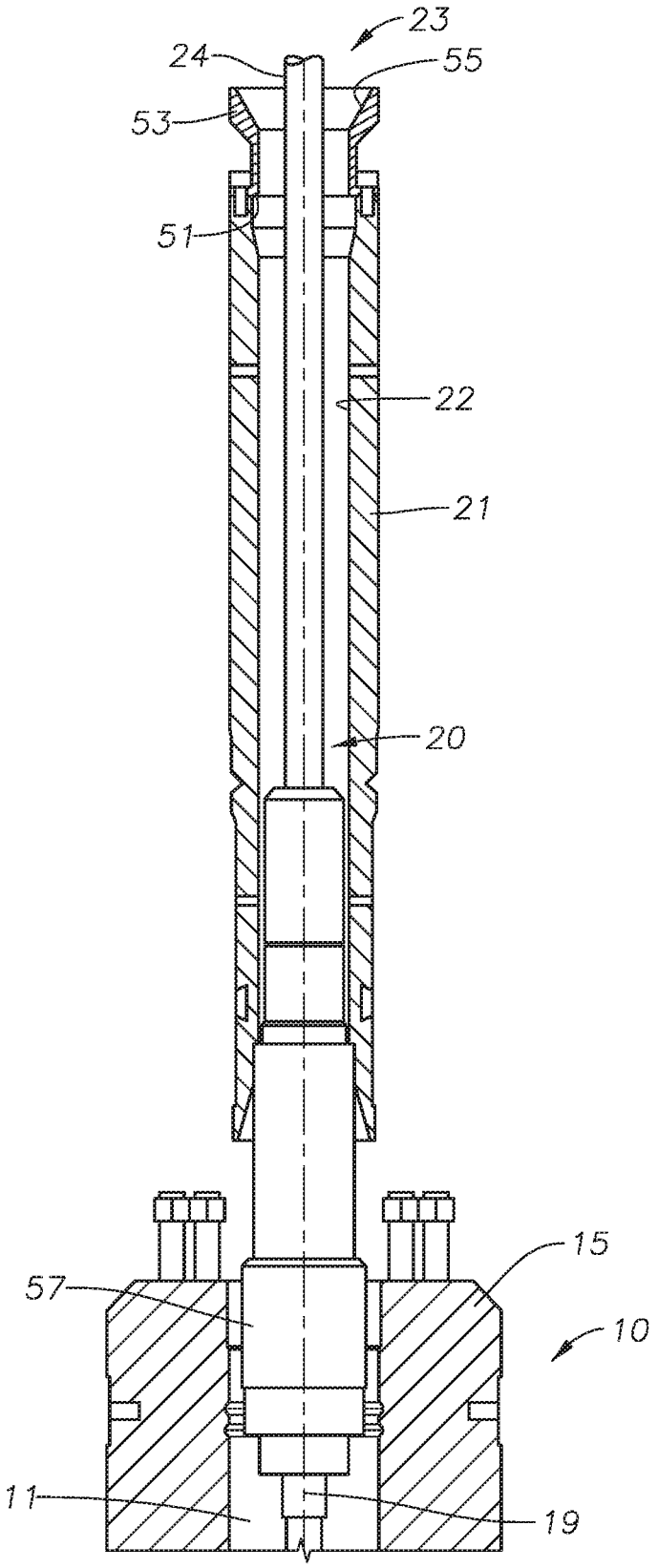
FIG. 4 is a sectional view of the bowl protector of FIG. 1 being lowered into the wellhead.

Referring to FIG. 1, well 10 has a wellhead assembly 15 located at an upper end of wellbore 11 of well 10. Wellhead assembly 15 is supported by base plate 12. Wellhead assembly 15 has an inner bore 17 and a central axis 19. A conductor pipe 13 and surface casing 14 extend downward from wellhead assembly 15 into well 10. In an example embodiment of well 10, well member 21 is a bowl protector with a central bore 22 and is shown landed coaxially within the inner bore 17 of wellhead assembly 15. The bowl protector is a generally elongated sleeve-like member that can prevent damage to surfaces of the inner bore 17 as equipment and tubular members pass through the wellhead assembly 15, for example, as a coiled tubing 24 is lowered through the wellhead assembly 15. Coiled tubing 24 is an elongated tubular member that is wound around a spool outside of well 10 and fed into well 10 off of such spool. The lower end 20 (FIG. 4) of coiled tubing 24 extends within wellbore 11 of well 10 and an upper end 23 of coiled tubing 24 is located outside of well 10. Coiled tubing 24 can have a smooth and slick outer diameter surface that is free of joints and other external shoulders. Tool 25 can be releasably attached to a central portion of coiled tubing 24 that is located between lower end 20 of coiled tubing 24 and upper end 23 of coiled tubing 24.

Figure 3:
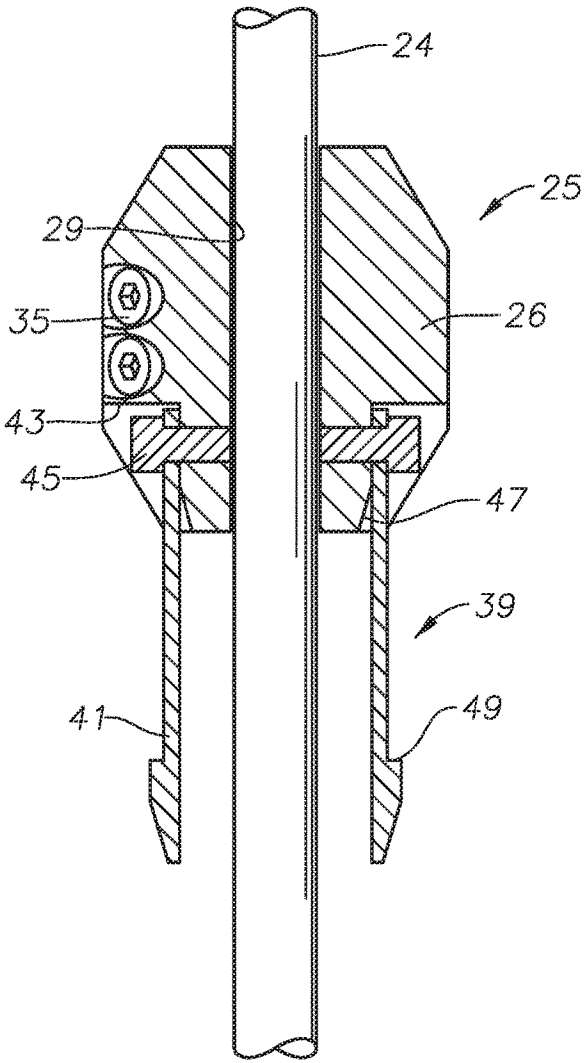
FIG. 3 is a section view of the tool of FIG. 1 after being clamped onto the coiled tubing.
Figure 2:
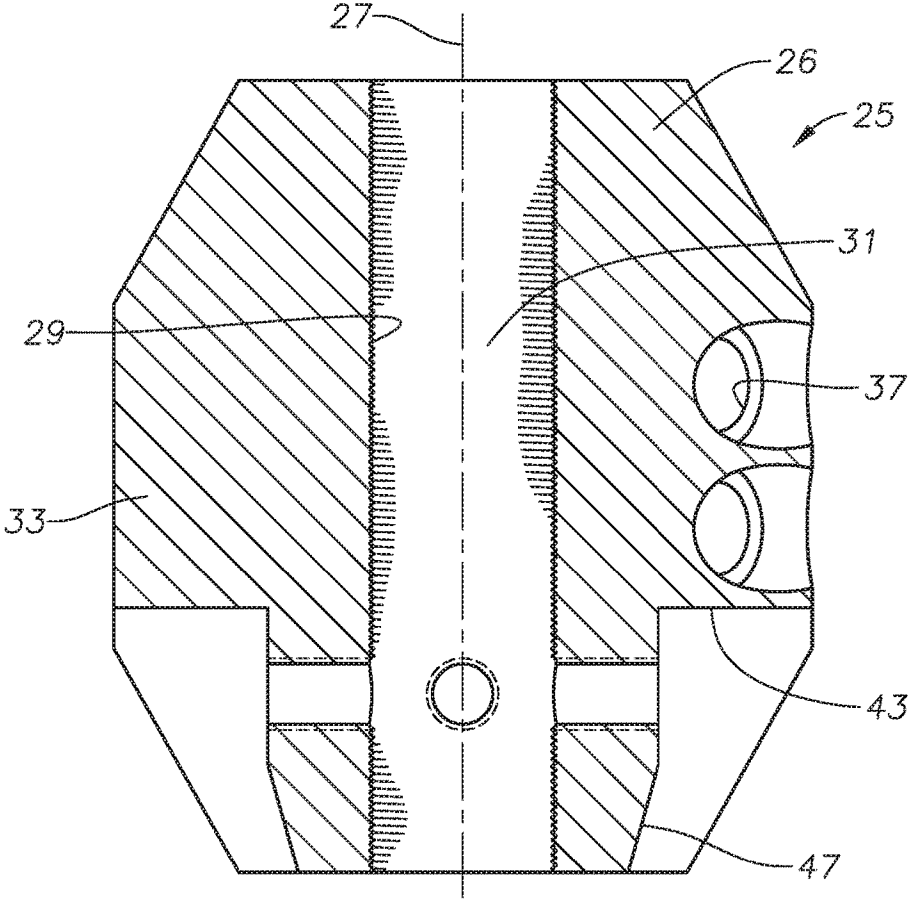
FIG. 2 is a section view of the tool of FIG. 1 before being clamped onto the coiled tubing.

Looking at FIGS. 2-3, tool 25 can have a tool body 26 with a central axis 27 and an inner bore with inner diameter surface 29. The inner bore with inner diameter surface 29 extends axially through tool body 26. Inner diameter surface 29 is sized to circumscribe coiled tubing 24. Inner diameter surface 29 has gripping feature 31. Gripping feature 31 can engage the outer diameter surface of coiled tubing 24. Gripping feature 31 limits relative axial movement between tool 25 and coiled tubing 24 when the inner diameter surface 29 of tool 25 circumscribes coiled tubing 24. Gripping feature 31 allows for tool 25 to be releasably attached at any position along coiled tubing 24 during coiled tubing operations. In addition, gripping feature 31 allows for tool 25 to be releasably attached at any position along coiled tubing 24 to move into well 10 with coiled tubing 24 without requiring a break in coiled tubing 24 to act as a connection point.

Gripping feature 31 can include a profile, such as grooves, threads, or other patterns of with peaks located on inner diameter surface 29. In the example embodiment of FIG. 2, gripping feature 31 is a gripping thread such as a fine pitch thread. In alternate embodiments, gripping feature 31 can be another type of pattern and texture that allows for a friction grip between inner diameter surface 29 of tool 25 and coiled tubing 24, such as a fine pitch acme thread with a flattened end on each peak. Gripping feature 31 is designed so that it does not deform or otherwise damage the slick outer diameter surface of coiled tubing 24, but provides a sufficient friction between gripping feature 31 and the outer diameter surface of coiled tubing 24 that tool 25 remains axially static relative to coiled tubing 24 as coiled tubing 24 is lowered into or retrieved out of wellbore 11 of well 10.

Tool 25 can be formed of two or more segments 33 of tool body 26. Forming tool 25 of two or more segments will allow an operator to position tool 25 around coiled tubing 24 so that tool 25 can circumscribe coiled tubing 24 at any location along coiled tubing 24 that is between lower end 20 of coiled tubing 24 and upper end 23 of coiled tubing 24. This allows an operator to utilize tool 25 within well 10 without having to pull coiled tubing 24 completely out of well 10. Segments 33 can be secured together around the central portion of coiled tubing 24 with fasteners. In the example embodiment of FIGS. 2-3, threaded members 35 extend through openings 37 of one segment 33 and into another segment 33 to hold such segments 33 together. In alternate embodiments, latches, clips, dogs, or other known fasteners can be used to hold segments 33 together around coiled tubing 24.

After tool 25 is releasably secured around coiled tubing 24, tool 25 can be used to perform a function within well 10. In the example embodiment of FIG. 1, tool 25 is a retrieval tool and can be used to retrieve well member 21 from wellhead assembly 15. In alternate embodiments, tool 25 can perform other functions within the well 10, such as acting as a packer, energizing a seal assembly, setting downhole equipment, retrieving other downhole components, or other actions that are known to be performed by tools within a well 10. In embodiments where tool 25 is used to set or install a well member within well 10, tool 25 can include a shear pin running feature so that shear pins can be sheared to release tool 25 from the well member when setting or installing the well member in well 10.

Tool 25 can include a tool feature 39. Tool feature 39 can be used to perform the function of tool 25 within well 10. For example, if tool 25 is a packer, tool feature 39 can be an inflatable packer member that engages an inner diameter of well 10. If tool 25 is used to energize a seal assembly or set downhole equipment, tool feature 39 can be an energizing member that engages the seal assembly or setting member that engages the downhole equipment to be set, respectively.

In the example embodiments shown, tool feature 39 is a latching assembly. The latching assembly can be used to engage a well member that is located in well 10 in association with the function that is performed by tool 25. In the example embodiment of FIG. 1, tool feature 39 can be used to attach tool 25 to well member 21, which in this example is a bowl protector, for performing the function of the tool 25, which function would include removing well member 21 from well 10. Tool feature 39 of FIG. 1 includes fingers 41 that extend axially from tool body 26. Upper ends of fingers 41 are connected to tool body 26. Tool body 26 includes recesses 43 into which the upper ends of fingers 41 are located. The upper ends of fingers 41 are secured to tool body 26 with connector members 45 (FIG. 3).

Recess 43 includes a tapered bottom end 47, to allow fingers 41 to flex radially inward. Fingers 41 of tool feature 39 are flexible radially inward for selectively latching to the well member. Fingers 41 are shown with an upward facing shoulder 49. Upward facing shoulder 49 can engage downward facing shoulder 51 of well member 21. Downward facing shoulder 49 is part of a retrieval collar 53 of well member 21. Retrieval collar 53 has a sloped shoulder 55 at an upper end. Sloped shoulder 55 defines a cone shaped inner diameter at the upper end of retrieval collar 53. Retrieval collar 53 can be secured to the main body of well member 21, or can be an integral part of well member 21.

As fingers 41 of tool feature 39 move axially downward with tool 25, fingers 41 slide along sloped shoulder 55 of retrieval collar 53, causing fingers 41 to flex radially inward as they pass into an upper end of well member 21. When upward facing shoulder 49 reaches downward facing shoulder 51, the lower ends of fingers 41 will move radially outward an amount necessary for upward facing shoulder 49 to engage downward facing shoulder 51. However, the outer diameter of fingers 41 in a relaxed, non-flexed state is greater than the inner diameter of retrieval collar 53 so that fingers 41 will retain a certain amount of radially inward flex when upward facing shoulder 49 engages downward facing shoulder 51 and will have sufficient bias radially outward so that upward facing shoulder 49 will remain in engagement downward facing shoulder 51 as tool 25 is pulling well member 21 out of wellhead assembly 15.

Tool feature 39 can therefore perform the function of engaging tool 25 using axial movement only and without any rotation required. Although the tool feature 39 has been described herein in an example embodiment, in alternate embodiment, the latching assembly of tool feature 39 can include alternate forms for engaging a well member 21 with a tool 25, for example by actuating a packer, using a spring member, having a biased split ring, or by other known methods of axial engagement.

In an example of operation, well member 21 can be a split bowl protector and tool 25 can be a retrieval tool. Looking at FIG. 4, a downhole member such as electric submersible pump 57 can be secured onto the lower end 20 of coiled tubing 24 before coiled tubing 24 is extended into well 10. The split bowl protector can be formed of segments that are secured around coiled tubing 24 axially above electric submersible pump 57 so that the split bowl protector circumscribes coiled tubing 24.

The lower end 20 of coiled tubing 24 can then be lowered into well 10 through wellhead assembly 15 with the split bowl protector carried into the wellhead assembly 15 on electric submersible pump 57. As split bowl protector passes through the wellhead assembly 15, the split bowl protector is landed within and supported by wellhead assembly 15 as the electric submersible pump 57 continues to travel downward within well 10 towards a final depth within the wellbore 11 of well 10. Coiled tubing 24 is lowered into well 10 from a single spool of tubing so that the upper end 23 of the coiled tubing remains outside of well 10 when electric submersible pump 57 is at its final depth within well 10.

When tool 25 is needed to preform a function in well 10, segments 26 of tool 25 can be releasably secured around coiled tubing 24 at any location along coiled tubing 24 between the upper and lower ends 20, 23 of coiled tubing 24. Tool 25 can then be lowered into well 10 on coiled tubing 24, the function can be performed by tool 25, and tool 25 can be retrieved by raising coiled tubing 24 out of well 10. Because coiled tubing 24 is not rotated, tool 25 is lowered into well 10, performs the function, and is retrieved from well 10 undergoing axial movement only.

Looking at FIG. 1, when tool 25 is a retrieval tool, the retrieval tool can be lowered towards the split bowl protector and can engage the retrieval collar 53 and slide along sloped shoulder 55 of retrieval collar 53, causing fingers 41 to flex radially inward as they pass into an upper end of well member 21. When upward facing shoulder 49 reaches downward facing shoulder 51, the lower ends of fingers 41 will move radially outward an amount necessary for upward facing shoulder 49 to engage downward facing shoulder 51. Fingers 41 will then act as radially outward biased spring members so that upward facing shoulder 49 will remain in engagement downward facing shoulder 51 as tool 25 is pulling well member 21 out of wellhead assembly 15. With well member 21 coupled to the retrieval tool, the operator can then raise the coiled tubing 24 to lift the retrieval tool and well member 21 out of the wellhead assembly 15. When the well member 21 reaches sufficient elevation to be able to be accessed by the operator, such as when the well member 21 reaches the rig floor, the operator can then remove the well member 21 from tool 25 and coiled tubing 24 by separating the segments of the well member 21 from each other. As an example, when well member 21 is a bowl protector, the segments can be separated from each other to remove the split bowl protector from tool 25 and coiled tubing 24. When well member 21 is being removed from tool 25 and coiled tubing 24, lower end 20 of coiled tubing 24 remains within well 10.

After well member 21 is removed from tool 25 and coiled tubing 24, tool 25 can be removed from coiled tubing 24 by separating the segments 26 from each other. When tool 25 is being removed from coiled tubing 24, lower end 20 of coiled tubing 24 remains within well 10.

During such described operations, coiled tubing 24 is a single continuous tubular member and the upper end 23 of coiled tubing 24 is outside of well 10 and coiled around a spool.

Embodiments described herein therefor provide a split bowl protector that prevents damage to the inner diameter of a wellhead assembly 15 while running coiled tubing 24 into a well 10. Because all of the components of the bowl protector can be retrieved prior to landing a casing hanger, the bowl protector does not take up space in wellhead assembly 15 while well 10 is producing.

The present disclosure described herein, therefore, is well adapted to carry out the objects and attain the ends and advantages mentioned, as well as others inherent therein. While example embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure disclosed herein and the scope of the appended claims.

What is claimed is:

1. A method for completing a well, the method comprising:

extending coiled tubing into the well through a wellhead assembly of the well, the coiled tubing having a lower end within the well and an upper end outside of the well;

releasably attaching a tool to a central portion of the coiled tubing between the lower end and the upper end, the tool having:

a tool body having a central axis and an inner diameter surface sized to circumscribe the coiled tubing;

a gripping feature located on the inner diameter surface, the gripping feature limiting relative axial movement between the tool and the coiled tubing when the inner diameter surface circumscribes the coiled tubing;

a tool feature, the tool feature extending from the tool body and shaped to engage a well member, the tool feature being flexible radially inward;

lowering the tool into the well with the coiled tubing and engaging a well member with the tool feature by pushing the tool feature radially inwards to engage a mating shoulder of the well member; and removing the tool from the well with the coiled tubing.

2. The method according to claim 1, further comprising after removing the tool from the well, removing the tool from the coiled tubing while retaining the lower end of the coiled tubing within the well.

3. The method according to claim 1, wherein the step of releasably attaching the tool to the central portion of the coiled tubing includes securing two or more segments of the tool body together around the central portion of the coiled tubing.

4. The method according to claim 1, wherein the tool feature extends axially from the tool body, the tool feature being biased radially outward to remain in engagement with the mating shoulder of the well member while the tool is removed from the well.

5. The method according to claim 1, wherein the well member is a bowl protector located within the wellhead assembly and step of engaging the well member with the tool feature includes attaching tool to the bowl protector for removing the bowl protector from the well.

6. The method according to claim 1, wherein the well member is a split bowl protector formed of segments and the method further includes securing the segments around the coiled tubing and lowering the split bowl protector into the wellhead assembly with the coiled tubing before releasably attaching the tool to the central portion of the coiled tubing.

7. The method according to claim 1, wherein the well member is a split bowl protector, the method further comprising attaching an electric submersible pump onto the lower end of the coiled tubing before the coiled tubing is extended into the well, the split bowl protector being landed within and supported by the wellhead assembly as the electric submersible pump travels towards a final depth within the well.

8. The method according to claim 1, wherein the gripping feature is a gripping thread formed on the inner diameter surface of the tool body, wherein the step of releasably attaching the tool to the central portion of the coiled tubing includes engaging the gripping thread with an outer diameter of the coiled tubing.

9. The method according to claim 1, further comprising after engaging the well member with the tool feature, performing a function with the tool within the well.

10. The method according to claim 9, wherein the step of performing the function with the tool within the well includes engaging a split bowl protector with the tool so that the split bowl protector moves with the tool when the tool is removed from the well.

11. The method according to claim 10, wherein the method further comprises after removing the split bowl protector from the well, removing the split bowl protector from the coiled tubing while retaining the lower end of the coiled tubing within the well.

12. The method of claim 1, wherein the gripping feature is externally activated.

13. The method of claim 1, wherein the tool further comprises:

a plurality of connectable segments that, when joined, circumscribe the coiled tubing.

14. A method for completing a well, the method comprising:

securing a downhole member to a lower end of a coiled tubing;

extending the coiled tubing into the well through a wellhead assembly of the well, so that the lower end is located within the well and an upper end of the coiled tubing is outside of the well;

releasably attaching a retrieval tool to a central portion of the coiled tubing between the lower end and the upper end, the retrieval tool having:

a tool body having a central axis and an inner diameter surface sized to circumscribe the coiled tubing;

a gripping feature located on the inner diameter surface, the gripping feature limiting relative axial movement between the retrieval tool and the coiled tubing when the inner diameter surface circumscribes the coiled tubing;

a latching assembly, the latching assembly extending from the tool body and shaped to engage a split bowl protector, at least a portion of the latching assembly being flexible radially inward;

lowering the retrieval tool into the well with the coiled tubing and engaging the split bowl protector with the latching assembly by pushing the latching assembly radially inwards to engage a mating shoulder of the split bowl protector; and retrieving the retrieval tool and the split bowl protector from the well with the coiled tubing.

15. The method according to claim 14, further comprising:

before extending the coiled tubing into the well, circumscribing the coiled tubing with the split bowl protector; and carrying the split bowl protector into the wellhead assembly on the downhole member.

16. The method of claim 14, wherein the gripping feature is externally activated.

17. The method of claim 14, wherein the tool further comprises:

a plurality of connectable segments that, when joined, circumscribe the coiled tubing.

18. A system for completing a well, the system comprising:

a tool releasably attachable to coiled tubing, the tool having:

a tool body having a central axis and an inner diameter surface sized and adapted to circumscribe a central portion of the coiled tubing between a lower end and an upper end;

a gripping feature located on the inner diameter surface, the gripping feature operable to limit relative axial movement between the tool and the coiled tubing when the inner diameter surface circumscribes the coiled tubing; and a tool feature, the tool feature extending from the tool body and shaped to engage a well member, the tool feature being flexible radially inward and capable of engaging the well member by pushing the tool feature radially inwards to engage a mating shoulder of the well member.

19. The system according to claim 18, wherein the tool feature extends axially from the tool body, the tool feature being flexible radially inward for selectively latching to the well member.

20. The system according to claim 18, wherein the well member is a bowl protector located within a wellhead assembly.

21. The system according to claim 18, wherein the well member is a split bowl protector formed of segments adapted to be selectively secured around the coiled tubing.

22. The system according to claim 18, wherein the well member is a split bowl protector carried by an electric submersible pump on the coiled tubing while the coiled tubing is lowered into the well.

23. The system according to claim 18, wherein the tool body has two or more segments that are adapted to be secured together around the central portion of the coiled tubing.

24. The system according to claim 18, wherein the gripping feature is a gripping thread formed on the inner diameter surface of the tool body.

25. The system of claim 18, wherein the gripping feature is externally activated.

26. The system of claim 18, wherein the tool further comprises:

a plurality of connectable segments that, when joined, circumscribe the coiled tubing.

* * * * *